United States Patent [19]

Retti

[11] Patent Number: 5,013,389

[45] Date of Patent: May 7, 1991

[54] WALLBOARD TAPING APPARATUS

[75] Inventor: Kahrl Retti, Timonium, Md.

[73] Assignee: Mudbuster, Inc., Baltimore, Md.

[21] Appl. No.: 518,320

[22] Filed: May 7, 1990

Related U.S. Application Data

[63] Continuation of Ser. No. 224,709, Jul. 27, 1988, abandoned.

[51] Int. Cl.[5] ..... B32B 31/00; B67D 5/64

[52] U.S. Cl. ..... 156/526; 156/575; 156/577; 156/579; 222/175

[58] Field of Search ..... 156/579, 574, 575, 577, 156/390, 524, 525, 526; 239/152, 153, 154; 222/81, 175

[56] References Cited

U.S. PATENT DOCUMENTS

| | | | |
|---|---|---|---|
| 1,617,066 | 2/1927 | Lush | 222/81 |
| 1,967,748 | 7/1934 | Ehle | 156/574 X |
| 2,815,142 | 12/1957 | Ames | 156/526 |
| 3,188,262 | 6/1965 | Torrison | 156/575 X |
| 3,260,638 | 7/1966 | Hoveland | 156/526 |
| 3,580,423 | 5/1971 | Gilman | 222/81 |
| 3,802,511 | 4/1974 | Good, Jr. | 239/154 |
| 3,960,643 | 6/1976 | Dargitz et al. | 156/579 |
| 4,105,490 | 8/1978 | Lass | 156/575 |
| 4,208,239 | 6/1980 | Lass | 156/579 |
| 4,257,540 | 3/1981 | Wegmann et al. | 239/332 X |
| 4,460,433 | 7/1984 | Boyd | 156/574 |
| 4,651,903 | 3/1987 | Pagliai | 239/153 |
| 4,707,202 | 11/1987 | Sweeny | 156/579 |
| 4,784,299 | 11/1988 | Stenger | 222/81 X |

*Primary Examiner*—David A. Simmons
*Assistant Examiner*—Chester T. Barry
*Attorney, Agent, or Firm*—Sherman and Shalloway

[57] ABSTRACT

An apparatus for taping joints between pieces of wallboard comprises a taping head, slidingly contactable with a wall, for substantially simultaneously applying a first layer of a joint compound to a joint between pieces of wallboard, embedding a wallboard tape in the first layer of the joint compound, and overcoating the embedded wallboard tape with at least one additional layer of the joint compound; a handle, connected to the taping head, for supporting the taping head, the handle being manually graspable by an operator, the handle having a fluid conduit formed therein for passing joint compound to the taping head; a tape supply mounted on the handle for supplying wallboard tape to the taping head; a backpack, wearable by the operator, for supporting a supply of the joint compound and for producing a pressurized stream of the joint compound; and a flexible connecting means for fluidically interconnecting the backpack and the fluid conduit to pass the pressurized stream of the joint compound from the backpack to the fluid conduit.

18 Claims, 10 Drawing Sheets

WALLBOARD TAPING APPARATUS

This application is a continuation of application Ser. No. 224,709, filed July 27, 1988, abandoned.

BACKGROUND OF THE INVENTION

1. Field Of The Invention

The present invention is directed to a process of taping joints between adjacent pieces of wallboard and an apparatus for effecting such taping of the joints. More particularly, the present invention is directed to a process and apparatus whereby a finished joint between adjacent pieces of wallboard may be completed in one step.

2. Description Of The Prior Art

Wallboard (also known as drywall) has become the dominant material in the production of interior building partitions. In particular, interior building partitions generally comprise a studwall of spaced parallel vertical members (studs) which are used as a support for preformed panels (wallboard) which are attached to the studwall by screws, nails, adhesive or any other conventional attachment system. Obviously, joints exist between adjacent preformed panels. In order to provide a continuous flat surface to the wall, it is necessary to "finish" the joint between adjacent panels. Generally, such "finishing" requires the building up of multiple layers of a mastic material (joint compound) and the blending of this joint compound into the panel surface so as to form the desired flat and contiguous wall surface. In order to facilitate this finishing of the joints, most manufacturers bevel the longitudinal edges of the wallboard panels so as to allow a buildup of mastic material which will then match the level of the major surface area of the preformed panel. Typically, the buildup of the mastic material in the joint area comprises the application of a first layer of mastic material, the embedding of a wallboard tape (for example a paper tape or a fiberglass tape) in the first layer of mastic material and then the overcoating of the tape with one or more, generally two layers of additional mastic material. This finishing of the joints is a time consuming process, since it is generally necessary to wait 24 hours between each application of a coat of mastic material in order to allow the coat to dry before the application of an overcoat of an additional layer of mastic material. Moreover, it is then necessary generally to sand the joint area so as to produce a finish which will match the major portion of the surface area of the wallboard panels. The "finishing" process thus is both time-consuming and labor-intensive.

In this regard, numerous attempts have been made to speed up and/or reduce the labor involved in the finishing products. In this regard, attention is directed to U.S. Pat. Nos. 2,666,323 and 2,824,442, to Ames, which disclose a tool designed to apply a layer of mastic to a wallboard joint.

U.S Pat. No. 3,007,837, to Goode, Jr., discloses a tape and joint compound dispensing wallboard taping machine which uses air pressure to supply joint compound to the head of the tool where it is applied to one side of the tape which side of the tape is then applied to the wall.

U.S. Pat. No. 3,131,108, to Kennard, discloses a wallboard taping machine which may have interchangeable heads for different conditions, e.g. flat joints versus corner joints.

U.S. Pat. No. 3,343,202, to Ames, discloses a tool for applying mastic to wallboard which includes a swingable arcuate trawling blade.

U.S. Pat. No. 3,404,060, to Taylor, Jr., discloses a wallboard taping machine including a supply of both joint compound and tape. The device includes a tape cutting knife which is automatically retractable and the tape has the joint compound applied on one side thereof.

U.S. Pat. No. 3,707,427, to Erickson, discloses a tape and joint compound dispenser wherein the tape is drawn through a joint compound reservoir so that the joint compound is applied on one side thereof. The quantity of joint compound in the dispensing chamber is automatically regulated.

U.S. Pat. No. 3,880,701, to Moree, discloses a tape and joint applying tool including applicator rolls and a blade for cutting the tape.

U.S. Pat. No. 3,925,145 discloses a tool for embedding tape into mastic at the corner of a room after the mastic and tape have been previously applied to the corner joint of the room.

U.S. Pat. No. 3,960,643, to Dargitz et al., discloses a device to apply a tape and covering finish plaster to a drywall seam in a single pass lengthwise thereover, wherein a relatively lightweight, hand supported frame has a unit thereon operative to first apply glue to a length of tape and then glue-affix the tape to the drywall over the seam and another unit on the frame operative, but trailing the tape gluing and applying unit, the apply a thin, smooth, layer of joint compound over the then-inplace tape.

U.S. Pat. No. 4,080,240 to Dysart, discloses a device for applying tape to wallboard and including valve-controlled mud supply. The device also includes a severing knife and a retractable V-shaped roller.

U.S. Pat. No. 4,086,121, to Ames, discloses a self-contained drywall taper having a hollow elongated body for holding mastic and supports a roll of tape with tape feeding means to deliver the tape to tape applying wheels then in turn apply it to cover a joint between two wallboard sections. A piston is slidably mounted in the hollow body and is automatically moved by a mechanism actuated by the rotating wheels, as they are moved over the wallboard surface, to force a layer of mastic onto the tape just prior to it being applied to the surface.

U.S. Pat. No. 4,090,914, to Hauk et al., discloses an apparatus for applying tape and adhesive to wallboard joints which is then convertible to deposit adhesive over the previously applied tape.

U.S. Pat. No. 4,196,028, to Mills, discloses a joint compound and tape applying tool having the provision of a following corner roller.

U.S. Pat. No. 4,208,239, to Lass, discloses a drywall taping machine including a flexible resilient wiper blade which presses the cement-laden tape into engagement with the wall and, in addition, feathers the cement onto the drywall along both side edges of the tape in a single pass. A backpack support for the joint compound supply is disclosed.

U.S. Pat. No. 4,309,238, to Hauk, discloses a drywall taping device which has a control for adjusting the tensioning force applied to toothed traction wheels thereof.

U.S. Pat. No. 4,358,337, to Johnson et al., discloses a tape applicator which utilizes a replaceable joint compound cartridge system.

U.S. Pat. No. 4,452,663, discloses a wallboard joint taping apparatus including an elongated frame having a tape press wheel mounted on the forward end with a compound reservoir mounted on the frame, intermediate the ends, with aligned slots through the lower edge of the wall with a source of tape mounted on the other end of the frame with the tape passing through the slots in the compound container for picking up taping compound on the surface thereof and passing over the roller for application and pressing by the press wheel into a joint between adjacent wallboard panels.

U.S. Pat. No. 4,516,868, to Molnar, discloses a device designed to apply a layer of joint compound over an already installed length of tape.

U.S. Pat. No. 4,592,797, to Carlson, discloses a tube including a cylindrical roller for applying pressure to embed a tape in adhesive, the roller being designed to allow the mud which is on the underside of the tape to flow over the top of the tape and coat that surface as well.

U.S. Pat. No. 4,608,116, to Braselton, discloses a baseboard edge taping tool which includes a severing knife and which is specifically designed to enable cutting operations at a corner.

Other references relating to tape dispensing and mastic dispensing include U.S. Pat. No. 2,972,428, to Dubbs, which discloses a tape applicator including microswitch controls for advancing, severing and applying a pressure sensitive tape. Movements of the tape are controlled incrementally on a cyclicable basis.

U.S. Pat. No. 3,785,535, to Ames, discloses a mastic supply pump outlet for filling different types of mastic-applying tools.

U.S. Pat. No. 4,406,247, to Baughman et al., discloses control of the flow of adhesive in an adhesive dispensing system wherein a logic control unit receives signals indicative of various process conditions and in response thereto controls adhesive dispensing.

U.S. Pat. No. 4,477,304, to Westermann, discloses a tool designed to apply a predetermined quantity of adhesive on a workpiece.

U.S. Pat. No. 4,584,047, to Vanderpool et al., discloses a hand-held labeling device which senses the position of the web of labels and controls other operation in response to this sensed condition.

Despite the great efforts which have been applied to reduce the labor and time involved in wallboard finishing, there is still a marked need for an efficient and useful tool which is easy to operate and which will allow a one-step finishing of wallboard.

SUMMARY OF THE INVENTION

Accordingly, it is an object of the present invention to provide a process for wallboard finishing which requires only a single step.

It is a further object of the present invention to provide an apparatus for effecting such a single step process.

As will become readily apparent hereinafter, the above objects of the invention are achieved by the provision of a method for taping joints between pieces of wallboard comprising the substantially simultaneous steps of: (a) applying a first layer of a joint compound to a joint between pieces of wallboard, the first layer of the joint compound having a first predetermined width, the first layer of the joint compound being substantially centered, widthwise, on the joint; (b) embedding a wallboard tape in the first layer of the joint compound, the wallboard tape having a width substantially equal to the first predetermined width, the wallboard tape being substantially centered, widthwise, on the joint; (c) overcoating the embedded wallboard tape with at least one additional layer of the joint compound, the at least one additional layer of the joint compound having a width greater than the first predetermined width, the at least one additional layer of the joint compound being substantially centered, widthwise, on the joint.

In a preferred embodiment of the method of the present invention, the step (c) comprises the substantially simultaneous sub-steps of: (c-1) overcoating the embedded wallboard tape with a second layer of the joint compound, the second layer of the joint compound having a second predetermined width, the second predetermined width being greater than the first predetermined width, the second layer of the joint compound being substantially centered, widthwise, on the joint; and (c-2) overcoating the second layer of the joint compound with a third layer of the joint compound, the third layer of the joint compound having a third predetermined width, the third predetermined width being greater than the second predetermined width, the third layer of the joint compound being substantially centered, widthwise, on the joint.

In a particularly preferred embodiment of the present method, the method comprises the further step (d) of imprinting a surface pattern on the third layer of the joint compound, preferably, the surface pattern matches a surface pattern on the wallboard.

The present invention also provides a novel joint compound, which is quick-setting, so as to allow for substantially simultaneous application of multiple layers of joint compound to a given joint. The joint compound comprises about 45% by weight of calcium sulfate, about 35% by weight of a room temperature evaporable alcohol, about 10% by weight of polyvinyl alcohol, about 5% by weight of polyvinyl acetate, about 3% by weight talc and about 2% by weight mica.

The present invention also provides an apparatus for taping joints between pieces of wallboard, comprising a taping head, slidingly contactable with a wall, for substantially simultaneously applying a first layer of a joint compound to a joint between pieces of wallboard, embedding a wallboard tape in the first layer of the joint compound and overcoating the embedded wallboard tape with at least one additional layer of the joint compound; a handle, connected to the taping head, for supporting the taping head, the handle being manually graspable by an operator, the handle having a fluid conduit formed therein for passing joint compound to the taping head; a tape supply mounted on the handle for supplying wallboard tape to the taping head; a backpack, wearable by the operator, for supporting a supply of the joint compound and for producing a pressurized stream of the joint compound; a flexible connection for fluidically interconnecting the backpack and the fluid conduit to pass the pressurized stream of the joint compound from the backpack to the fluid conduit.

In a preferred embodiment of the apparatus according to the present invention, the taping head comprises a first support plate, attached to the handle; a guide means, attached to the first support plate, for guiding a wallboard tape of predetermined width being applied to a joint; first orifice means, attached to the first support plate, for feeding a first layer of joint compound to a surface of the wallboard tape intermediate the joint and the wallboard tape, the first orifice means fluidically connected to the fluid conduit means; a second support plate, releasably attachable to the handle; biasing means, attached to the second support plate, for yieldably urging the wallboard tape and, hence, the first layer of joint compound, into contact with the wall, when the taping head is in contact with the wall, to embed the wallboard tape in the first layer of joint compound; second orifice means, formed in the second support plate proximate the first support plate, for overcoating the wallboard tape with a second layer of the joint compound, the second orifice means having a width greater than the wallboard tape, the second orifice means being centered, widthwise, with respect to the guide means; first passage means, formed in the second support plate, for fluidically connecting the second orifice means and the fluid conduit means; first gate means, pivotally connected to the second support plate for pivotal movement between a first position and a second position, the first gate means preventing flow of joint compound through the second orifice means when in the first position and allowing flow of joint compound through the second orifice means when in the second position; second biasing means for yieldably urging the first gate means to the first position; third orifice means, formed in the second support plate remote from the first support plate, for overcoating the second layer of the joint compound with a third layer of the joint compound, the third orifice means having a width greater than the second orifice means, the third orifice means being centered, widthwise, with respect to the guide means; second passage means, formed in the second support plate, for fluidically connecting the third orifice means and the fluid conduit means; second gate means, pivotally connected to the second support plate for pivotal movement between a first position and a second position, the second gate means preventing flow of joint compound through the third orifice means when in the first position and allowing flow of joint compound through the third orifice means when in the second position; third biasing means for yieldably urging the second gate means to the first position; first resilient wiper means, mounted on the second support plate intermediate the second orifice means and the third orifice means for spreading and smoothing the second layer of the joint compound; second resilient wiper blade means, mounted on the second support plate on the opposite side of the third orifice means from the first resilient wiper blade means, for spreading and smoothing the third layer of the joint compound.

In a particularly preferred embodiment, the taping head further comprises roller means, mounted on the second support plate, for imprinting a surface pattern on the third layer of the joint compound, wherein the imprinted surface pattern preferably matches a surface pattern on the wallboard.

DETAILED DESCRIPTION OF THE INVENTION

Figures 1A, 1B:
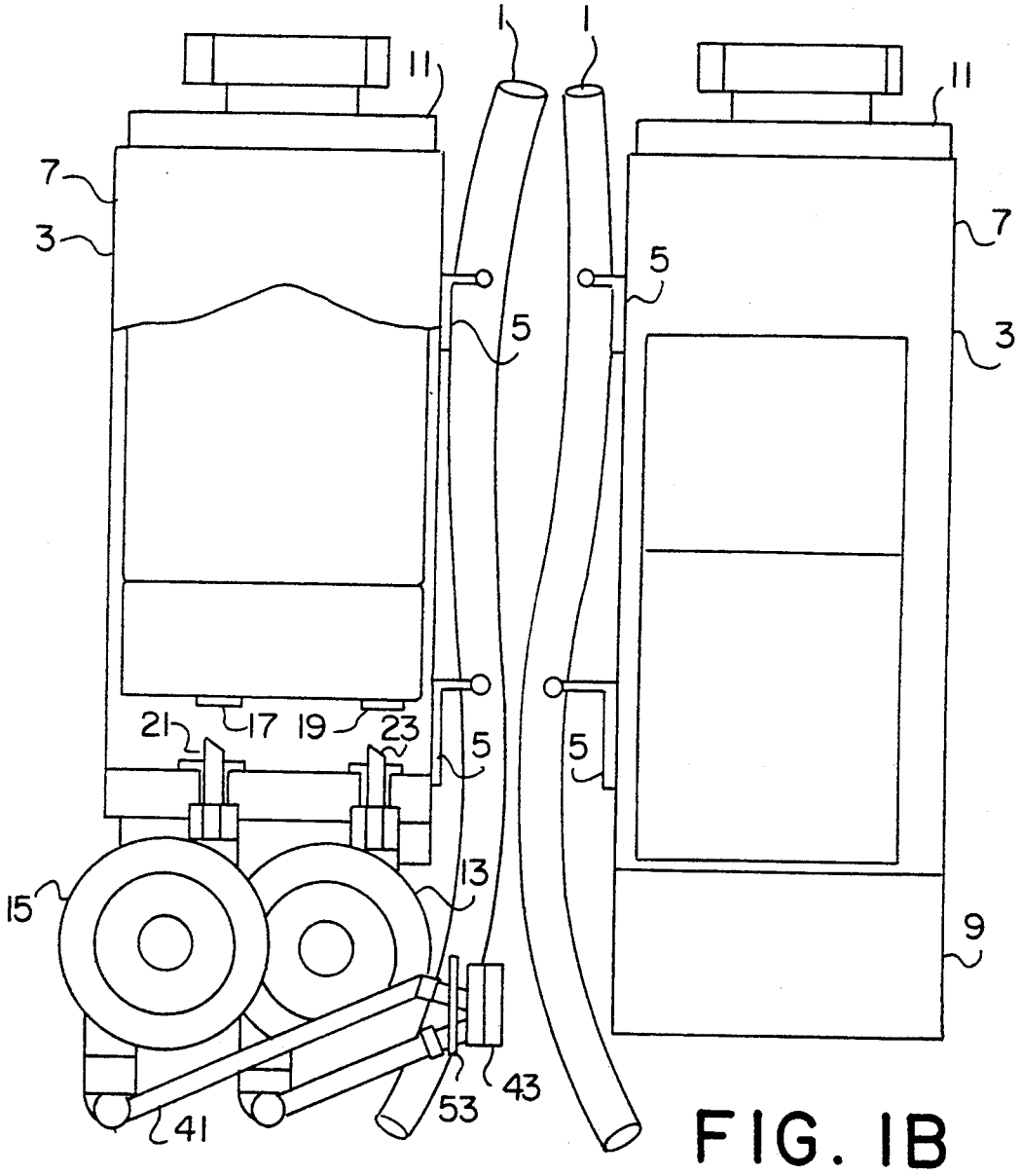
FIG. 1A is a partially cutaway view of the right hand side of the backpack unit according to the present invention.
FIG. 1B is a left hand view of the backpack unit according to the present invention.

Turning now to the drawing figures, FIGS. 1A and 1B (a right hand view and a left hand view, respectively) illustrate the backpack portion of the present invention. In particular, the backpack comprises a support frame 1 which is adapted to be fitted with suitable webbing (not shown) so as to allow the backpack to be worn on the back of an operator. A container support 3 is attached to the support frame by brackets 5 which may be screwed to or welded to support frame 1 and container support 3. Container support 3 comprises an upper section 7 in the form of a box open at its top which is receivable of a unit container 11 of joint compound. The container support also comprises a lower section 9 which contains pumps 13 and 15 and related equipment, as will be described hereinafter.

The unit container 11 is fitted with a pair of grommets 17 and 19 which define puncturable portions of the bottom wall of the container 11. When the container 11 is placed within the upper section 7, a pair of upstanding pipe portions 21 and 23, which are cut at an angle so as to form a "sharpened" edge, are aligned with the grommets 17 and 19, respectively, and insertion of the container 11 fully into the upper section 7 causes these upstanding pipe sections 21 and 23 to pierce the wall of the container and provide fluid communication between the container and the pumps as will be described hereinafter.

Figure 2:
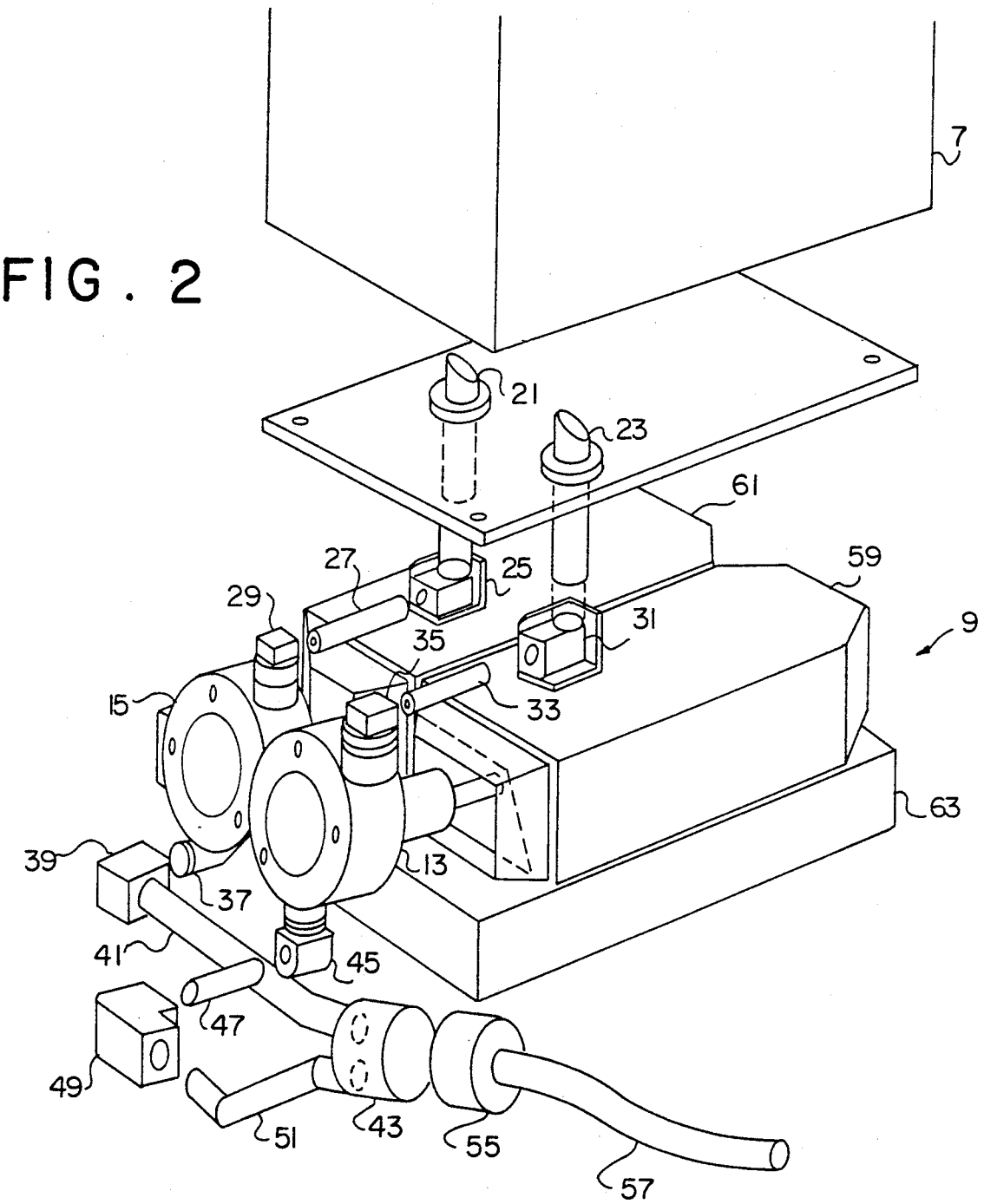
FIG. 2 is a partially exploded view of the backpack unit showing the pumping mechanism.

As may best be seen in FIG. 2, pipe section 21 is connected through elbow 25 and pipe 27 to the inlet 29 of pump 15. Likewise, pipe 23 is connected through elbow 31 and pipe 33 to the inlet 35 of pump 13. In turn, the outlet 37 of pump 15 is connected via elbow 39 and pipe 41 to outlet fitting 43. Likewise, the outlet 45 of pump 13 is connected via pipe 47, elbow 49 and pipe 51 to the outlet fitting 43. The outlet fitting 43 and/or the pipes 41 and 51 may be supported by a bracket 53 mounted on the support frame 1. The outlet fitting 43 is detachably connectable to an inlet fitting 55 of flexible hose 57.

Pumps 13 and 15, which are preferably positive displacement pumps, and most preferably rotary flexible impeller (vane) pumps, are driven by motors 59 and 61, respectively. Motors 59 and 61 are preferably electric motors driven by 120 V electrical supply. The electrical motors 59 and 61 may be supplied with power by a flexible electrical cable connected to a suitable source of power.

Figure 4:
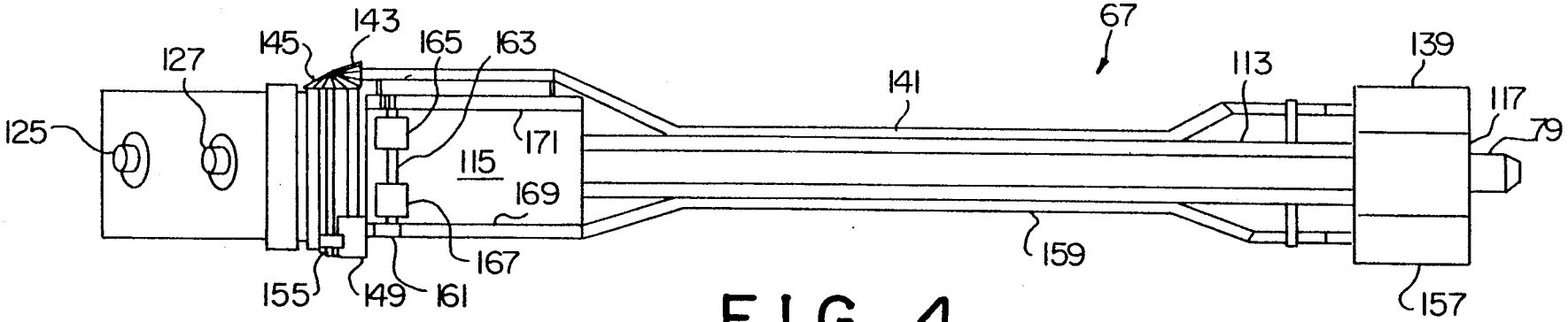
FIG. 4 illustrates another section of the handle according to the present invention.
Figure 3:
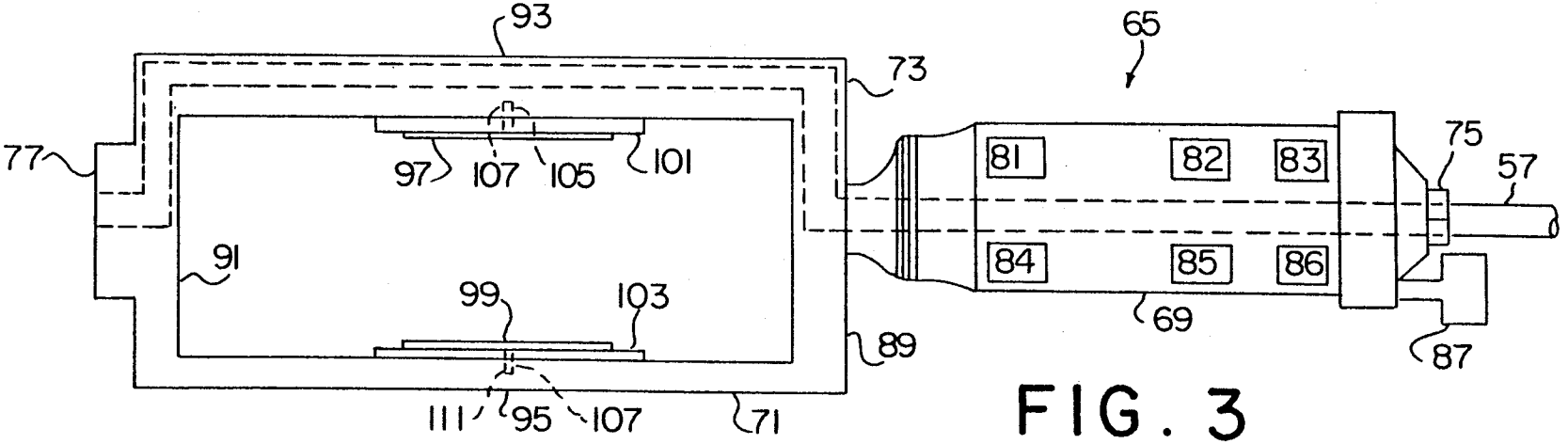
FIG. 3 illustrates a section of the handle according to the present invention.

Joint compound which is pumped from unit container 11, via pumps 13 and 15, to flexible hose 57 is passed to the handle assembly. The handle assembly comprises a control section 65 (as shown in FIG. 3) and a delivery section 67 (as shown in FIG. 4).

The control section 65 comprises a handgrip 69 and a tape supply element 71. A fluid passageway 73 (as shown in dotted lines in FIG. 3) passes through the control section 65 from a socket 75, where flexible hose 57 is fluidically connected to the fluid passage 73, to a socket 77 wherein a plug 79 of the delivery section 67 may be received so as to fluidically connect with the delivery section 67. The handgrip 69 is fitted with switches (in the form of buttons 81–86) for operation of the various functions of the apparatus, as will be disclosed hereinafter. The handgrip 69 is also fitted with a socket 87 for electrical connection of the switches to the various electrical elements in the backpack unit. Additionally, the handgrip 69 is also fitted with an additional socket (not shown) for connection (via a cable connection) to the various electrical devices in the delivery section 67.

Figure 5:
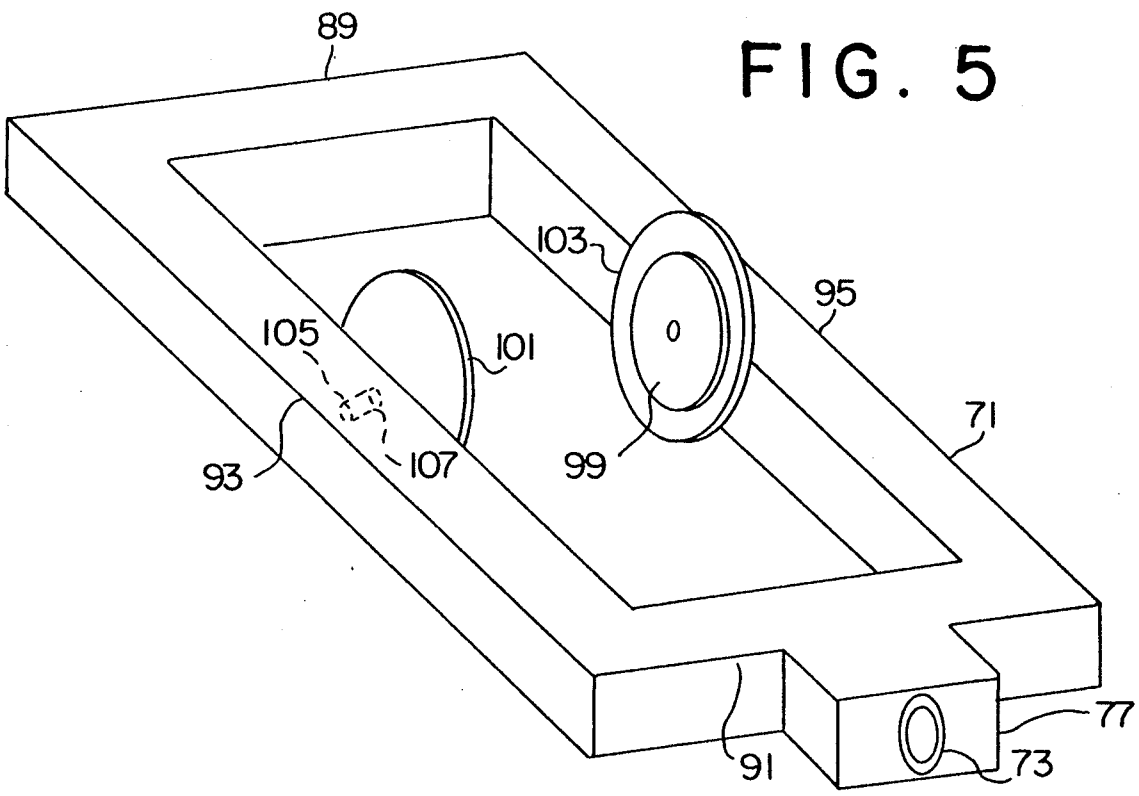
FIG. 5 is a perspective view of a portion of the handle section illustrated in FIG. 3.
Figure 6:
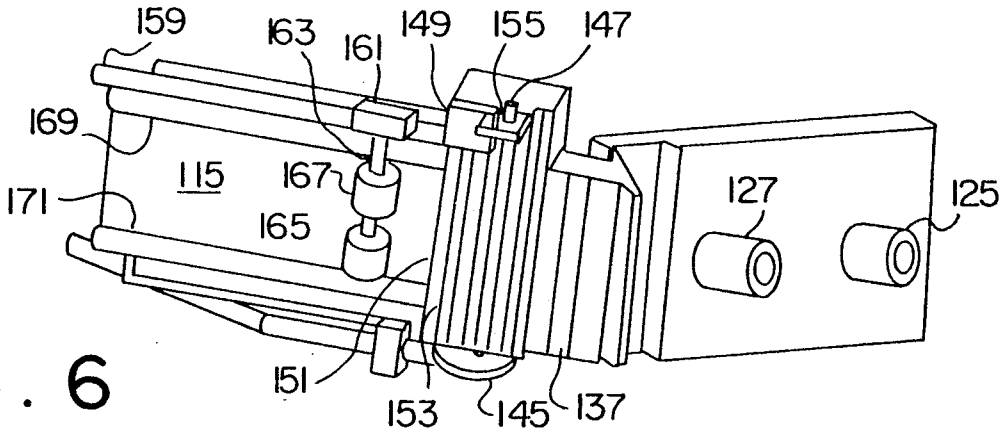
FIG. 6 is a perspective view of a portion of the handle section illustrated in FIG. 4.

The tape supply element 71 is shaped substantially as a hollow rectangle (as best seen in FIG. 5) and comprises first and second cross members, 89 and 91, and first and second connecting members 93 and 95. A first disc 97 is rotatably mounted on connecting member 93. A second disc 99 is rotatably mounted on connecting member 95. The mounting of discs 97 and 99 is such that the discs are rotatably mounted substantially coaxially. Disc 97 is provided with a radially extending flange 101 and disc 99 is provided with a radially extending flange 103. At least one of the discs 97 and 99 is moveable axially with respect to the other disc by being supported for rotation on a pin 105 or 107, respectively, received within a corresponding bore 109 or 111 formed in cross member 93 or 95. A spring (not shown) may be fitted in bore 109 and/or 111 so as to yieldably urge at least one of discs 97 and 99 axially toward the other disc. The discs are of such a diameter as to be received within the core of a roll wallboard tape, whereby a roll of wallboard tape may be supported on the discs for rotation so as to supply tape through the delivery section 67 of the handle.

Figure 7:
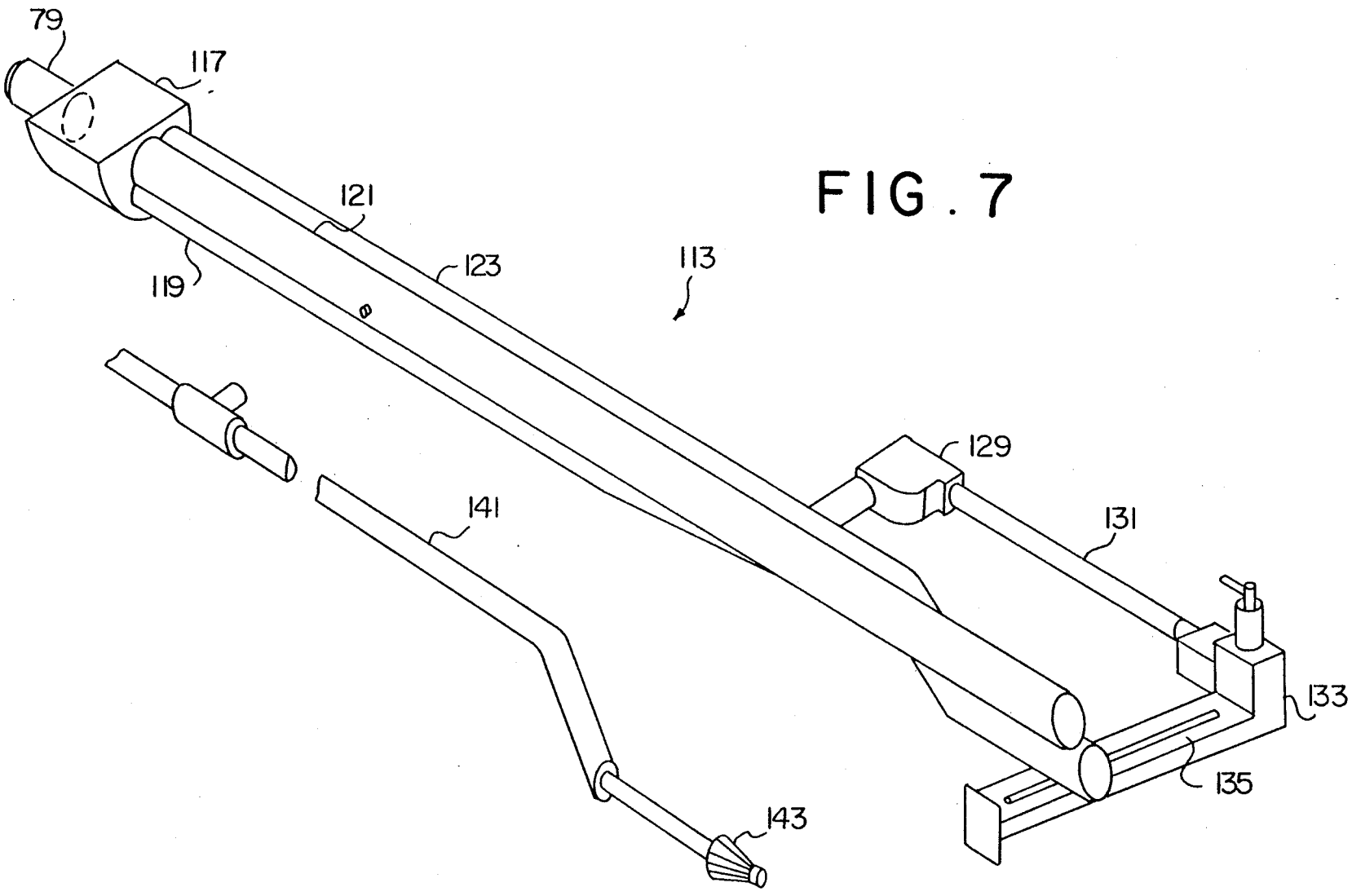
FIG. 7 is a partially exploded view of certain elements of the handle section illustrated in FIG. 4.

The delivery section 67 substantially comprises a fluid conduit assembly 113 and a support plate 115. The fluid conduit assembly, as best seen in FIG. 7, comprises the plug 79 which is fluidically connected to a chamber 117 which in turn is connected to three fluid supply pipes 119, 121 and 123. Pipe 121 is fluidically connected to supply nozzle 125 and pipe 123 is fluidically connected to supply nozzle 127. Pipe 119 is fluidically connected via elbow 129, pipe 131 and valve 133 to tape supply nozzle 135, which when assembled is disposed in region 137 of the support plate 115.

A first stepping motor 139 is mounted on chamber 117 and connected via flexible drive cable 141 to a first bevel gear 143. First bevel gear 143 mates with a second bevel gear 145 which is mounted for rotation with a first shaft 147, shaft 147 having a screw thread formed on the outer periphery thereof. A slider 149 is slidably mounted on rails 151 and 153 with a knife edge (not shown) depending in the gap between rails 151 and 153. Connection member 155 is connected to slider 149 and is fitted with a screw threaded bore corresponding to the screw thread formed on the outer periphery of the first shaft 147, whereby rotation of the first shaft will cause movement of the slider 149 along rails 151 and 153, thereby drawing the knife edge across plate 115. Reversal of the rotation of the first shaft 147 by reversal of the rotation of the first stepping motor 139 will draw the slider, and hence the knife edge, back across plate 115. By alternating the direction of rotation of first stepping motor 139, the knife edge may be drawn back and forth across plate 115 as needed.

A second stepping motor 157 is also mounted on chamber 117 and is connected via flexible drive cable 159 to gear box 161. Gear box 161, in turn, contains gears to drive second shaft 163 upon which friction rollers 165, 167 are mounted for rotation therewith. Plate 115 is fitted with guide rails 169 and 171 so as to guide wallboard tape beneath rollers 165 and 167, beneath rails 151 and 153 as well as shaft 147 and over tape supply nozzle 135.

In operation, a tape passing between guide rails 169 and 171 on plate 115 may be advanced a predetermined amount by actuation of stepping motor 157 so as to cause a predetermined rotation of shaft 163 and the friction rollers 165 and 167 mounted thereon. Likewise, the tape may be cut by actuation of the stepping motor 139 and the concomitant rotation of shaft 147 causing slider 149 (which is fitted with a knife edge) to slide across the width of the tape on plate 115. In this regard, for example, switch 81 on handgrip 69 can actuate stepping motor 157 so as to cause the tape to advance in a predetermined amount. Likewise, switch 84 can be connected to stepping motor 139 so as to cause movement of slider 149 across the tape. It should be noted, however, that switch 84 alternatively changes the polarity of electrical current fed to stepping motor 139 so as to alternately draw the slider across and then back across the plate 115. As the tape passes over tape supply nozzle 135 joint compound is applied to the lower face 173 of the tape 175.

Figure 8:
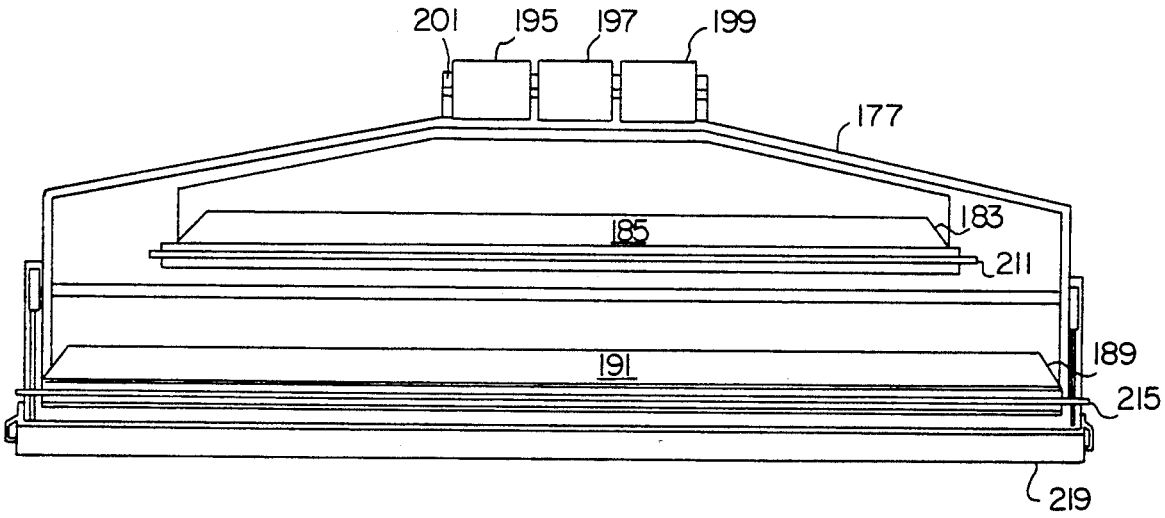
FIG. 8 is a bottom view of the taping head unit.
Figure 9:
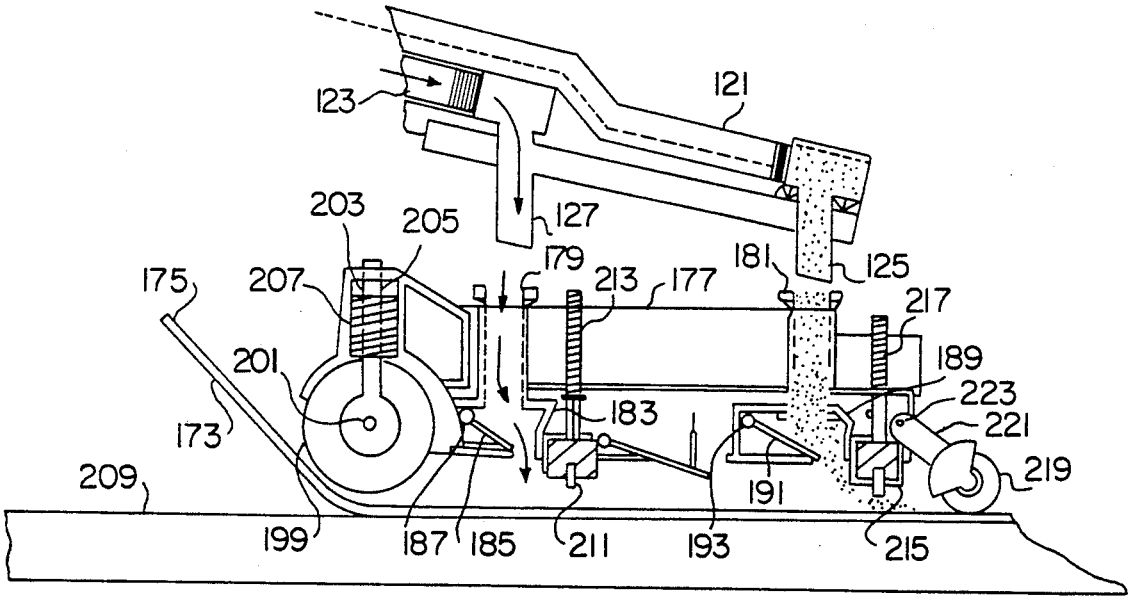
FIG. 9 is a partially cutaway view of the taping head unit.

Turning now to FIGS. 8 and 9, a second plate 177 is releasably attachable to the delivery section 67 of the handle. In this regard, as may best be seen in FIG. 9, supply nozzles 125 and 127 may be respectively received in passages 179 and 181 in a snap-fit or force-fit manner. Passage 179 communicates with an orifice 183 formed in plate 177. The orifice 183 is fitted with a gate 185 which is pivotally mounted on plate 177 so as to be moveable from a first position in which fluid passage through the orifice is prevented to a second position (as shown in FIG. 9) wherein fluid passage through orifice 183 is permitted. The gate may be biased, by a torsion spring 187, so as to be yieldably urged to the first position.

In a similar manner, passage 181 communicates with an orifice 189 formed in plate 177. Orifice 189 is also fitted with a gate 191 pivotally connected to plate 177 so as to be moveable from a first position in which fluid flow through the orifice is prevented and a second position in which fluid flow through the orifice is permitted. Gate 191 may also be biased, as by torsion spring 193, so as to yieldably urge the gate to the first position. Rollers 195, 197 and 199 may be supported on a shaft 201 which in turn is journaled in a support member 203 carried in bore 205 formed in the plate 177. A biasing spring 207 yieldably urges the rollers downwardly so as to force the lower side 173 of tape 175 into contact with wallboard 209. A first resilient wiper blade 211 adjustably mounted in the plate 177 as by a screw support 213 smoothes and spreads joint compound delivered through the orifice 183. A second flexible wiper blade 215 adjustably mounted in plate 177 as by screw support 217 moves and spreads the joint compound delivered to the wallboard through orifice 189. A printing roller 219 may be provided with a surface pattern matching the surface pattern of the wallboard 209 so as to aid in disguising the position of the seams formed by the present apparatus. The roller 219 may be supported by support 221 which in turn is pivotally attached to plate 177 and may be biased into contact with the seam surface as by a torsion spring 223.

Figure 10:
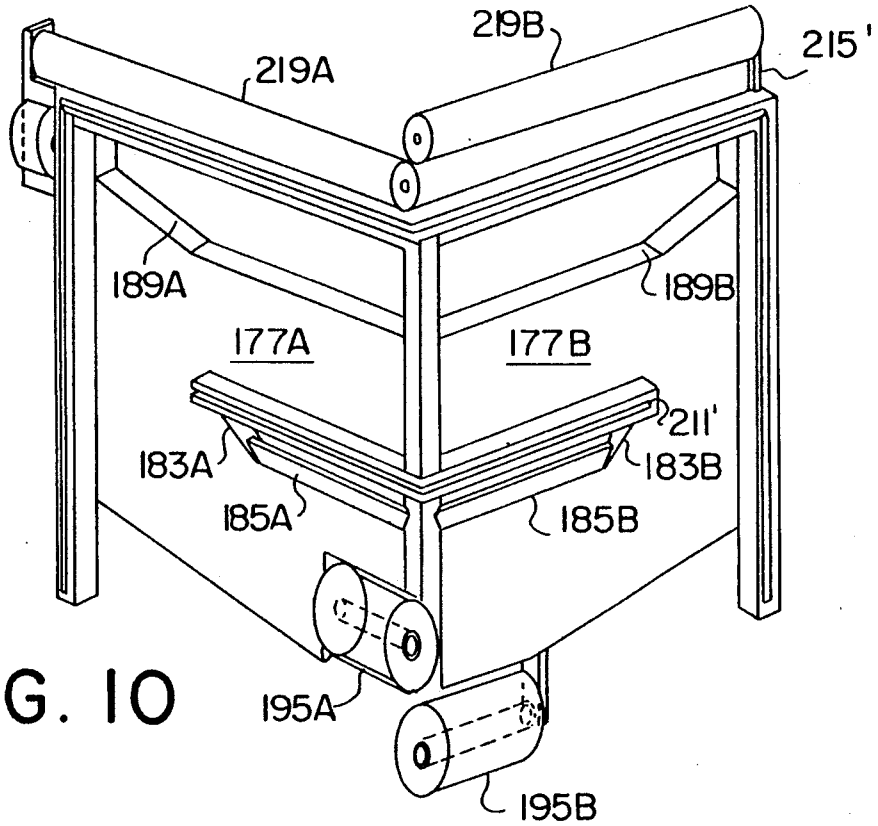
FIG. 10 is a perspective view of the underside of an alternative taping head unit.
Figure 11:
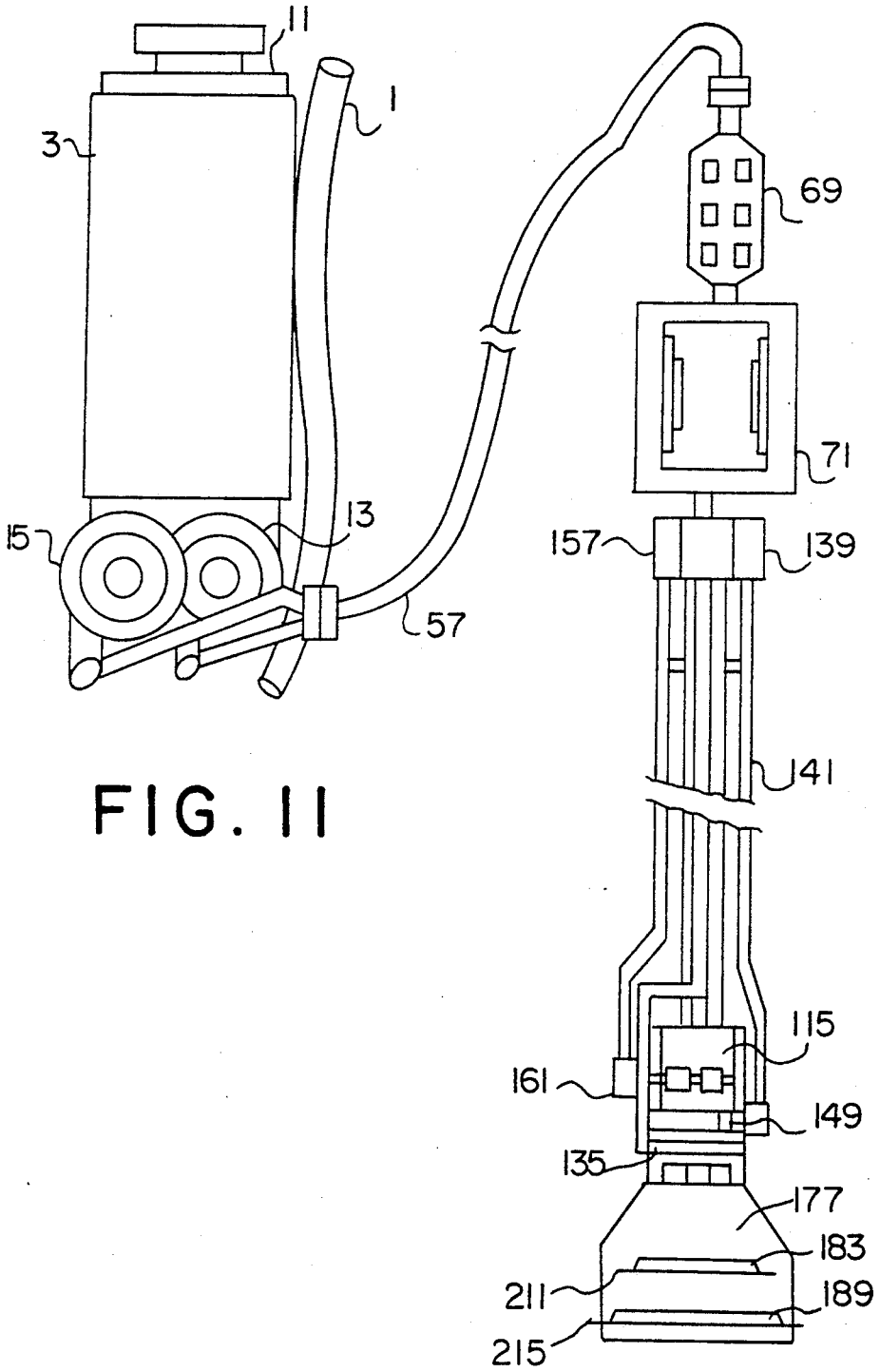
FIG. 11 is an illustration of the completely assembled apparatus.

As shown in FIG. 10, the second support plate may also be formed in other configurations so as to allow specialized taping operations, e.g. the taping of inside corners. In this regard, the plate is formed in two sections 177A and 177B which are at right angles to one another. A pair of printing rollers 219A and 219B is also provided, each of the rollers being disposed so as to imprint one side of the seam. Likewise, a pair of rollers 195A and 195B are also provided so as to bias the tape into contact with the respective sides of the seam. A pair of orifices 183A and 183B are provided so as to place a first coat of joint compound on the upper surface of the tape and these orifices are controlled in a manner similar to the flat taping head shown in FIGS. 8 and 9 by the provision of gates 185A and 185B. Likewise, a pair of second orifices 189A and 189B are also provided so as to place a second coat of joint compound on the tape. Although not shown in FIG. 10, a pair of gates analogous to gate 191 in the flat taping head may also be provided to control the flow of joint compound through orifice 189A and orifice 189B. A first wiper 211' and a second wiper 215' are also provided so as to spread and smooth the respective coats of joint compound.

In operation, the operator will turn on the apparatus as by the depression of switch 82 which causes power to be supplied to motor 59 which drives pump 13. However, the pressure developed by pump 13 is insufficient by itself to overcome the biasing action of springs 187 and 193 in maintaining gates 185 and 191 in the closed position. However, joint compound will be supplied through tape supply nozzle 135 to the underside of the wallboard tape. Immediately upon turning on the apparatus, the operator will then activate the wallboard tape advance so as to cause the coating of the bottom portion of a predetermined length of wallboard tape which will then be placed into contact with the wallboard 209 by pressure from rollers 195, 197 and 199. The wallboard tape which is so pressed against the wallboard is effectively adhesively adhered to the wallboard and the operator may now move the taping head downwardly (or upwardly) along the wall so as to draw tape from the tape supply wheel (the rollers 165 and 167 permitting such passage of the tape slidingly thereover). With the beginning of motion of the taping head across the wall, the operator may then activate motor 61 driving pump 15 so as to overcome the bias of springs 187 and 198 holding gates 185 and 191 shut. By controlling the operation of pump 15, the operator may control the amount of joint compound being fed to the head so as to suit the particular application conditions being dealt with. When the operator comes to the end of the stroke, the knife edge carried on slider 149 may be activated so as to cut the tape off and allow the operator to finish the end of the tape. This cycle may then be repeated in taping the next seam in the operation.

In the case where the operator is merely patching nail or screw holes in the wallboard, e.g. or in those situations where no tape feed is desired, the valve 133 may be closed so as to prevent the feed of joint compound through tape supply nozzle 135 and joint compound may be fed exclusively through orifice 183 and orifice 189.

In order to effectuate the process and apparatus of the present invention, it is necessary to utilize a fast-drying joint compound so as to allow multiple coats to be disposed one upon the other in a substantially simultaneous manner. In this regard, Applicant has developed a joint compound comprising about 45% by weight of calcium sulfate, about 35% by weight of a room temperature, evaporable alcohol, about 10% by weight of polyvinyl alcohol, about 5% by weight of polyvinyl acetate, about 3% by weight talc, and about 2% by weight mica.

By room temperature evaporable alcohol is meant an alcohol which will readily evaporate under conventional room temperatures in the building trades. Methyl, ethyl and propyl alcohols having been found suitable for this use. Preferably, the alcohol comprises commercially denatured ethyl alcohol.

As previously noted, the present apparatus allows for the taping of joints between pieces of wallboard by the substantially simultaneous steps of (a) applying a first layer of a joint compound to the joint between pieces of wallboard, the first layer of joint compound having a first predetermined width, the first layer of the joint compound being substantially centered, widthwise, on the joint; (b) embedding a wallboard tape in the first layer of the joint compound, the wallboard tape having a width substantially equal to the first predetermined width, the wallboard tape being substantially centered, widthwise, on the joint; and (c) overcoating of the embedded wallboard tape with at least one additional layer of the joint compound, the at least one additional layer of joint compound having a width greater than the first predetermined width, the at least one additional layer of the joint compound being substantially centered, widthwise, on the joint.

What is claimed is:

1. An apparatus for taping joints between pieces of wallboard comprising:

a taping head means, slidingly contactable with a wall, for substantially simultaneously applying a first layer of a joint compound to a joint between pieces of wallboard, embedding a wallboard tap in said first layer of said joint compound, overcoating said embedded wallboard tape with a second layer of said joint compound, and overcoating said second layer of said joint compound with a third layer of said joint compound;

a handle means, connectable to said taping head means, for supporting said taping head means, said handle means being manually graspable by an operator, said handle means having fluid conduit means formed therein for passing joint compound to said taping head means;

tape supplying means, mounted on said handle means, for supplying wallboard tape to said taping head means;

backpack means, wearable by said operator, for supporting a supply of said joint compound and for producing a pressurized stream of said joint compound;

flexible connecting means for fluidically interconnecting said backpack means and said fluid conduit means to pass said pressurized stream of said joint compound from said backpack means to said fluid conduit means;

wherein said taping mead means comprises:

a first support plate, attached to said handle means;

a guide means, attached to said first support plate, for guiding a wallboard tape of predetermined width being applied to a joint;

a first orifice means, attached to said first support plate, for feeding a first layer of joint compound to a surface of said wall board tape intermediate said joint and said wallboard tape, said first orifice means fluidically connected to said fluid conduit means;

a tape cutting means, mounted on said first support plate, intermediate said guide means and said first orifice means, for cutting said wallboard tape widthwise after having passed through said guide means;

a second support plate, releasably attachable to said handle means;

second orifice means, formed in said second support plate proximate said first support plate, of overcoating said wallboard tap with a second layer of said joint compound, said second orifice means having a width greater than said wallboard tape, said second orifice means being centered, widthwise with respect to said guide means;

third orifice means, formed in said second support plate remote from said first support plate, for overcoating said second layer of said joint compound with a third layer of said joint compound, said third orifice means having a width greater than said second orifice means, said third orifice means being centered, widthwise, with respect to said guide means.

2. The apparatus according to claim 1, wherein said taping head means further comprises roller means, mounted on said second support plate, for imprinting a surface pattern on said third layer of said joint compound.

3. The apparatus according to claim 2, wherein said surface pattern imprinted on said third layer of said joint compound matches a surface pattern on said wallboard.

4. The apparatus according to claim 1, wherein said taping head means further comprises tape advance means, mounted on said first support plate, for advancing a predetermined length of said wallboard tape through said guide means.

5. The apparatus according to claim 1, wherein said tape supply means comprises:

a first disc rotatably mounted on said handle, said first disc having a radially extending flange;

a second disc rotatably mounted on said handle, said second disc having a radially extending flange;

said first and second discs being rotatable about a common axis and movable on said axis relative to one another;

said first and second discs being receivable within a core supporting a roll of wallboard tape;

biasing means for causing at least one of said first and second discs to yieldably move toward the other.

6. The apparatus according to claim 1, wherein said backpack means comprises:

a support frame;

a container support mounted on said support frame, said container support being receivable of a unit container of said joint compound in a predetermined orientation;

pump means, mounted on said support frame, for producing a pressurized stream of said joint compound;

power supply means, mounted on said support frame, for driving said pump means;

piping means for supplying joint compound from a unit container mounted in said container support to said pump means;

outlet means for fluidically receiving said pressurized stream of said joint compound from said pump means, said outlet means including connection means for releasably connecting said outlet means to said flexible connecting means.

7. The apparatus according to claim 6, wherein said pump means comprises a pair of pumps.

8. The apparatus according to claim 7, wherein said power supply means comprises a pair of electric motors, each of said electric motors driving a respective pump.

9. The apparatus according to claim 8, wherein said power supply means further comprises rechargeable battery means for supplying electric power to said electric motors.

10. The apparatus according to claim 7, wherein said piping means further includes means for piercing a wall of said unit container, when it is received within said container support, to form a hermetic fluidic connection between said container and said pumps.

11. The apparatus according to claim 8, wherein said taping head means further comprises biasing means, attached to said second support plate, for yieldably urging said wallboard tape and, hence, said first layer of joint compound, into contact with said wall, when said taping head means is in contact with said wall, to embed said wallboard tape in said first layer of joint compound.

12. The apparatus according to claim 1, further comprising:

first passage means, formed in said second support plate, for fluidically connecting said second orifice means and said fluid conduit means;

first gate means, pivotally connected to said second support plate for pivotal movement between a first position and a second position, said first gate means preventing flow of joint compound through said second orifice means when in said firsts position and allowing flow of joint compound through said second orifice means when in said second position;

second biasing means for yieldably urging said first gate means to said first position;

second passage means, formed in said second support plate, for fluidically connecting said third orifice means and said fluid conduit means;

second gate means, pivotally connected to said second support plate for pivotal movement between a first position and a second position, said second gate means preventing flow of joint compound through said third orifice means when in said first position and allowing flow of joint compound through said third orifice means when in said second position; and third biasing means for yieldably urging said second gate means to said first position.

13. The apparatus according to claim 12, wherein said taping head means furthest comprises:

first resilient wiper blade means, mounted on said second support plate intermediate said second orifice means and said third orifice means, for spreading and smoothing said second layer of said joint compound; and second resilient wiper blade means, mounted on said second support plate on the opposite side of said third orifice means from said first resilient wiper blade means, for spreading and smoothing said third layer of said joint compound.

14. An apparatus for taping joints between pieces of wallboard comprising:

a taping head means slidingly contactable with a wall, for substantially simultaneously applying a first layer of a joint compound to a joint between pieces of wallboard, embedding a wallboard tape in said first layer of said joint compound, and overcoating said embedded wallboard tape with at least one additional layer of said joint compound;

a handle, connectable to said taping head means, for supporting said taping head means, said handle being manually graspable by an operator, said handle having fluid conduit means formed therein for passing joint compound to said taping head means;

tape supplying means, mounted on said handle, for supplying wallboard tape to said taping head means;

backpack means, wearable by said operator, for supporting a supply of said joint compound and for producing a pressurized stream of said joint compound;

flexible connecting means for fluidically interconnecting said backpack means and said fluid conduit means to pass said pressurized stream of said joint compound from said backpack means to said fluid conduit means;

a first support plate, attached to said handle;

a guide means, attached to said first support plate, for guiding a wallboard tape of predetermined width being applied to a joint;

first orifice means, attached to said first support plate, for feeding a first layer of joint compound to a surface of said wallboard tape intermediate said joint and said wallboard tape, said first orifice means fluidically connected to said fluid conduit means;

a second support plate, releasably attachable to said handle;

biasing means, attached to said second support plate, for yieldably urging said wallboard tape and, hence, said first layer of joint compound, into contact with said wall, when said taping head means is in contact with said wall, to embed said wallboard tape in said first layer of joint compound;

second orifice means, formed in said second support plate proximate said first support plate, for overcoating said wallboard tape with a second layer of said joint compound, said second orifice means having a width greater than said wallboard tape, said second orifice means being centered, widthwise, with respect to said guide means;

first passage means, formed in said second support plate, for fluidically connecting said second orifice means and said fluid conduit means;

first gate means, pivotally connected to said second support plate for pivotal movement between a first position and a second position, said first gate means preventing flow of joint compound through said second orifice means when in said first position and allowing flow of joint compound through said second orifice means when in said second position;

second biasing means for yieldably purging said first gate to said first position;

third orifice means, formed in said second support plate remote from said first support plate, for overcoating said second layer of said joint compound with a third layer of said joint compound, said third orifice means having a width greater than said second orifice means, said third orifice means being centered, widthwise, with respect to said guide means;

second passage means, formed in said second support plate, for fluidically connecting said third orifice means and said fluid conduit means;

second gate means, pivotally connected to said second support plate for pivotal movement between a first position and a second position, said second gate means preventing flow of joint compound through said third orifice means when in said first position and allowing flow of joint compound through said third orifice means when in said second position;

third biasing means for yieldably urging said second gate means to said first position;

first resilient wiper blade means, mounted on said second support plate intermediate said second orifice means and said third orifice means, for spreading and smoothing said second layer of said joint compound; and second resilient wiper blade means, mounted on said second support plate on the opposite side of said third orifice means from said first resilient wiper blade means, for spreading and smoothing said third layer o said joint compound.

15. An apparatus for taping joints between pieces of wallboard comprising:

taping head means, slidingly contactable with a wall, for substantially simultaneously applying a first layer of a joint compound to a joint between pieces of wallboard, embedding a wallboard tape in said first layer of said joint compound, and overcoating said embedded wallboard tape with at least one additional layer of said joint compound;

a handle, connectable to said taping head means for supporting said taping head means;

tape supply means, mounted on said handle, for supplying wallboard tape to said taping head means;

supply means for supplying a pressurized stream of joint compound to said taping head means;

said taping head means comprising:

a first support plate attached to said handle;

guide means, attached to said first support plate, for guiding a wallboard tape of predetermined width being applied to a joint;

first orifice means, attached to said first support plate, for directing a first portion of said pressurized stream of joint compound to a first surface of said wallboard tape intermediate said joint and said wallboard tape such that a first layer of joint compound adheres to said tape;

a second support plate releasably attachable to said handle;

applying means for applying said wallboard tape against said wallboard joint, when said taping head means is in contact with said wall, to embed said wallboard tap into said first layer of joint compound;

second orifice means, formed in said second support plate proximate said first support plate, for directing a second portion of said pressurized stream of joint compound to a second surface of said wallboard tape with a second layer of joint compound; and third orifice means, formed in said second support plate remote from said first support plate, for directing a third portion of said pressurized stream of joint compound to said second layer of joint compound so as to overcoat said second layer of joint compound with a third layer of joint compound.

16. An apparatus for taping joints between pieces of wallboard, comprising:

taping head means, sliding contactable with a wall for substantially simultaneously applying a first layer of a joint compound to a joint between pieces of wallboard, embedding a wallboard tape in said first layer o said joint compound, and overcoating said embedded wallboard tape with at least one additional layer of said joint compounds;

a handle, connectable to said taping head means, for supporting said taping head means;

tape supply means, mounted on said handle, for supplying wallboard tape to said taping head means;

supply means for supplying a pressurized stream of joint compound to said taping head means;

said taping head means comprising:

first orifice means for directing a first portion of said pressurized stream of joint compound to a first surface of said wallboard tape intermediate said joint and said wallboard tape such that a first layer of joint compound adheres to said tape;

applying means for applying said wallboard tape against said wallboard joint, when said taping head means is in contact with said wall, to embed said wallboard tape into said first layer of joint compound;

second orifice means for directing a second portion of said pressurized stream of joint compound to a second surface of said wallboard tape so as to overcoat said wallboard tape with a second layer of said joint compound;

second orifice gate means for normally preventing flow of joint compound through said second orifice means, but allowing flow of said joint compound when said pressurized stream of joint compound is pressurized sufficiently to overcome a predetermined bias force;

said supply means comprising:

a supply of joint compound;

fluid conduit means for fluidically connecting said supply of joint compound with said first and second orifice means of said taping head means;

first pump means for delivering a first amount of said joint compound through said fluid conduit means at a pressure insufficient to overcome said predetermined bias force but sufficient to force said joint compound through said first orifice means; and second pump means for delivering additional joint compound through said fluid conduit means at a controllably variable pressure which, when coupled with the pressure created by said first pump means, is sufficient to overcome said predetermined bias force to thus force joint compound through said second orifice means.

17. The apparatus according to claim 16, furthers comprising:

a power supply means for driving said first and second pump means;

said power supply means comprising a first electric motor for driving said first pump means and a second electric motor for driving said second pump means; and rechargeable battery means for supplying electric power to said first and second electric motors.

18. The apparatus according to claim 17, wherein said first and second electric motors, said rechargeable battery means, said first and second pumps and said supply of joint compound are mounted to a backpack adapted to be worn on an operator's back.

* * * * *